US009486911B1

(12) United States Patent
Liu

(10) Patent No.: US 9,486,911 B1
(45) **Date of Patent: *Nov. 8, 2016**

(54) TOOL CABINET

(71) Applicant: Chia-Ming Liu, Douliou (TW)

(72) Inventor: Chia-Ming Liu, Douliou (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/974,310

(22) Filed: Dec. 18, 2015

(30) Foreign Application Priority Data

Jul. 22, 2015 (CN) ..... 2015 2 0531931 U

(51) Int. Cl.

| | |
|---|---|
| ***A47B 46/00*** | (2006.01) |
| ***B25H 1/16*** | (2006.01) |
| ***A47B 83/04*** | (2006.01) |
| ***A47B 13/08*** | (2006.01) |
| ***B25H 1/12*** | (2006.01) |
| *A47B 31/00* | (2006.01) |

(52) U.S. Cl.

CPC ..... *B25H 1/16* (2013.01); *A47B 13/081* (2013.01); *A47B 83/045* (2013.01); *B25H 1/12* (2013.01); *A47B 31/00* (2013.01)

(58) Field of Classification Search

CPC ..... A47B 9/04; A47B 13/00; A47B 37/00; A47B 45/00; A47B 46/00; A47B 83/00; A47B 96/18; A47B 17/02; A47B 83/045; A47B 13/081; B25H 1/12; B25H 1/16

USPC ..... 312/196, 223.2, 306, 312, 317.3, 319.5, 312/902; 108/59, 106, 147.19, 147

See application file for complete search history.

(56) References Cited

U.S. PATENT DOCUMENTS 654,922 A * 7/1900 Schipkowsky ..... A47B 17/036 312/196
742,118 A * 10/1903 Huddleston ..... A47B 31/00 108/17
1,099,521 A * 6/1914 Sprung ..... E05B 65/0003 312/196
1,247,590 A * 11/1917 Sprung ..... A47B 51/00 312/196
1,459,930 A * 6/1923 Riehle ..... B25H 1/04 144/285
2,019,455 A * 10/1935 Lehman ..... A47B 17/02 312/196
2,931,685 A * 4/1960 Myra ..... A47B 17/02 108/32
3,245,741 A * 4/1966 Bartlett ..... A47B 17/02 312/196
3,297,387 A * 1/1967 Parsons ..... A47B 29/00 112/217.1
4,627,364 A * 12/1986 Klein ..... A47B 9/04 108/147
4,740,044 A * 4/1988 Taylor ..... A47B 21/03 312/196
5,797,666 A * 8/1998 Park ..... A47B 21/0073 312/223.3
6,213,575 B1 * 4/2001 Brin, Jr. ..... A47B 77/04 108/147
6,312,069 B1 * 11/2001 Weng ..... A47B 9/06 108/147
8,033,620 B2 * 10/2011 Retchloff ..... B25H 3/00 312/290
2002/0101139 A1 * 8/2002 Lee ..... A47B 21/0073 312/196
2005/0046315 A1 * 3/2005 Doane ..... A47B 17/02 312/196
2009/0127986 A1 * 5/2009 Carelsen ..... A47B 21/0073 312/204
2012/0025681 A1 * 2/2012 Ton ..... A47B 46/00 312/309

* cited by examiner

*Primary Examiner* — James O Hansen
(74) *Attorney, Agent, or Firm* — Trop Pruner & Hu, P.C.

(57) ABSTRACT

A tool cabinet includes a cabinet housing that has a top cover, a plurality of drawers that are movably disposed in the cabinet housing, a working platform unit, two slide rails, two lifting units, a linkage unit, and a drive unit. The working platform is displaceable relative to the top cover between a lifted position, where the platform member is distal from the cabinet housing, and a lowered position, where the platform member is proximate to the cabinet housing, cooperates with the top cover to define an anti-jamming gap therebetween, and is not allowed to move further toward the top cover.

10 Claims, 7 Drawing Sheets

TOOL CABINET

CROSS-REFERENCE TO RELATED APPLICATION

This application claims priority of Chinese Application No. 201520531931.4, filed on Jul. 22, 2015.

FIELD

The disclosure relates to a storage equipment, more particularly to a tool cabinet with an elevatable working platform.

BACKGROUND

A conventional tool cabinet includes a cabinet housing having a top wall, and a plurality of drawers arranged along an up-down direction in the cabinet housing. The drawers are used for storing and systematizing various items, such as files, hand tools and power tools. The tools can be taken out from the drawers and put to use on the top wall of the cabinet housing, which also serves as a working platform. However, since the height of the top wall is unadjustable, the conventional tool cabinet is not suitable for users of different heights to work thereon. Consequently, an alternative working location may be required, which greatly inconveniences the working process.

SUMMARY

Therefore, an object of the disclosure is to provide a tool cabinet that can alleviate at least one of the drawbacks of the prior arts.

According to the disclosure, the tool cabinet includes a cabinet housing that has a top cover, a plurality of drawers that are movably disposed in the cabinet housing, a working platform unit, two slide rails, two lifting units, a linkage unit, and a drive unit.

The working platform unit has a platform member disposed above the top cover, and two extension members extending respectively and downwardly from two opposite ends of the platform member through the top cover. The working platform is displaceable relative to the top cover between a lifted position, where the platform member is distal from the cabinet housing, and a lowered position, where the platform member is proximate to the cabinet housing, cooperates with the top cover to define an anti-jamming gap therebetween, and is not allowed to move further toward the top cover. The two slide rails are respectively disposed at opposite sides of the cabinet housing, and are respectively and slidably engaged by the extension members. The two lifting units are respectively and movably disposed at the opposite sides of the cabinet housing, and are connected to the working platform unit. The linkage unit interconnects the lifting units and synchronizes movement of the lifting units. The drive unit is drivingly connected to one of the lifting units, and is operable to drive synchronized movements of the lifting units to move the working platform unit along the slide rails between the lifted position and the lowered position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
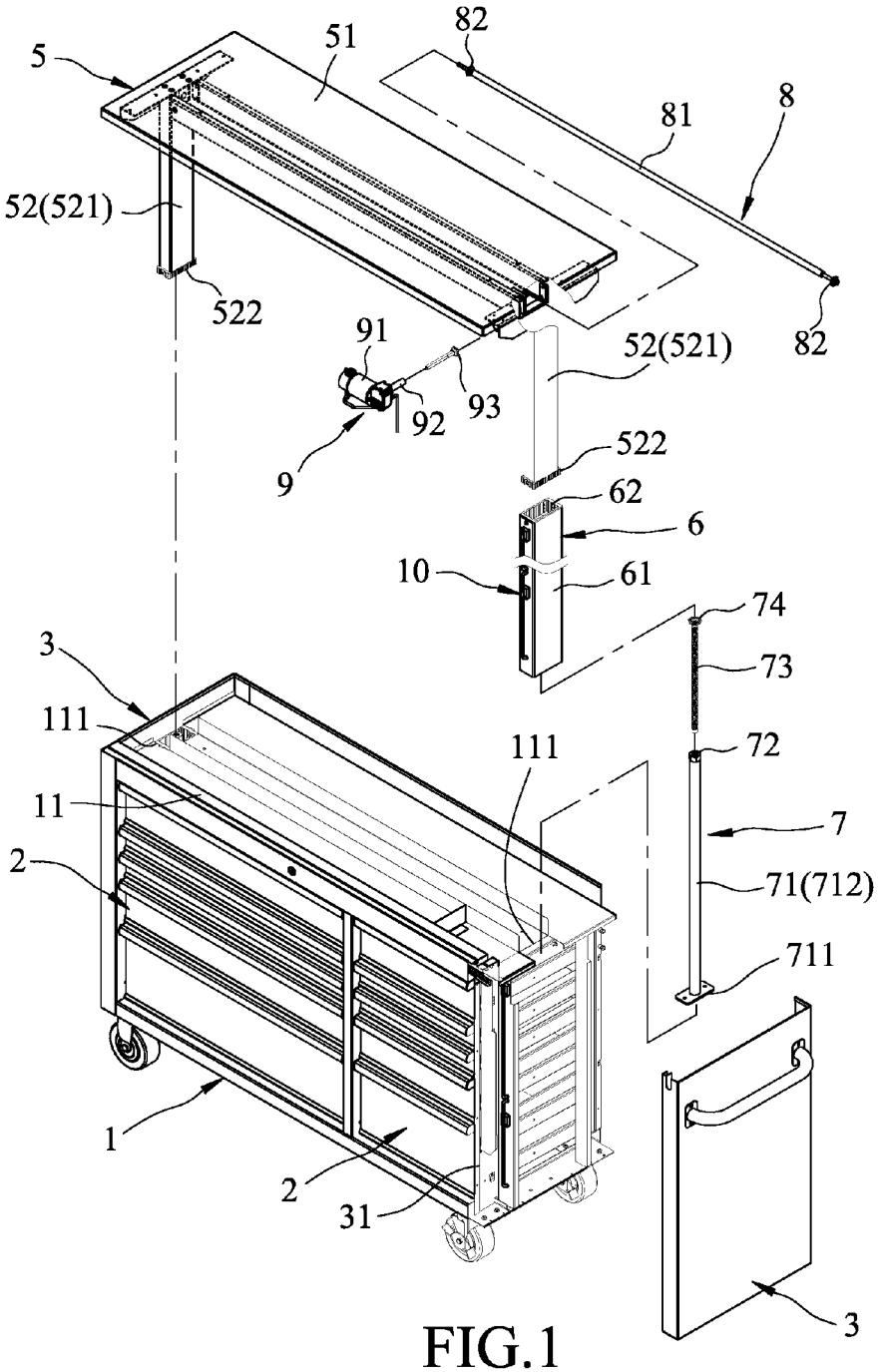
FIG. 1 is a partly exploded perspective view of an embodiment of a tool cabinet according to the disclosure.
Figure 2:
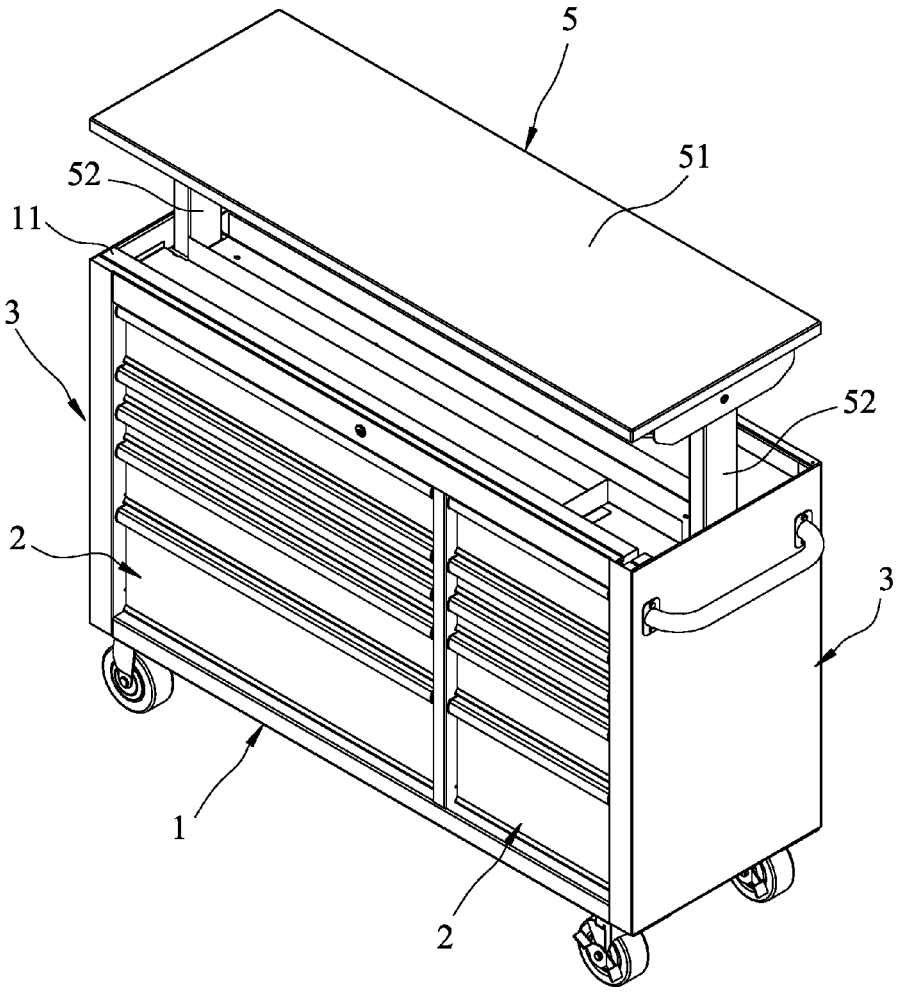
FIG. 2 is an assembled perspective view of the embodiment illustrating a working platform unit of the tool cabinet at a lifted position.
Figure 3:
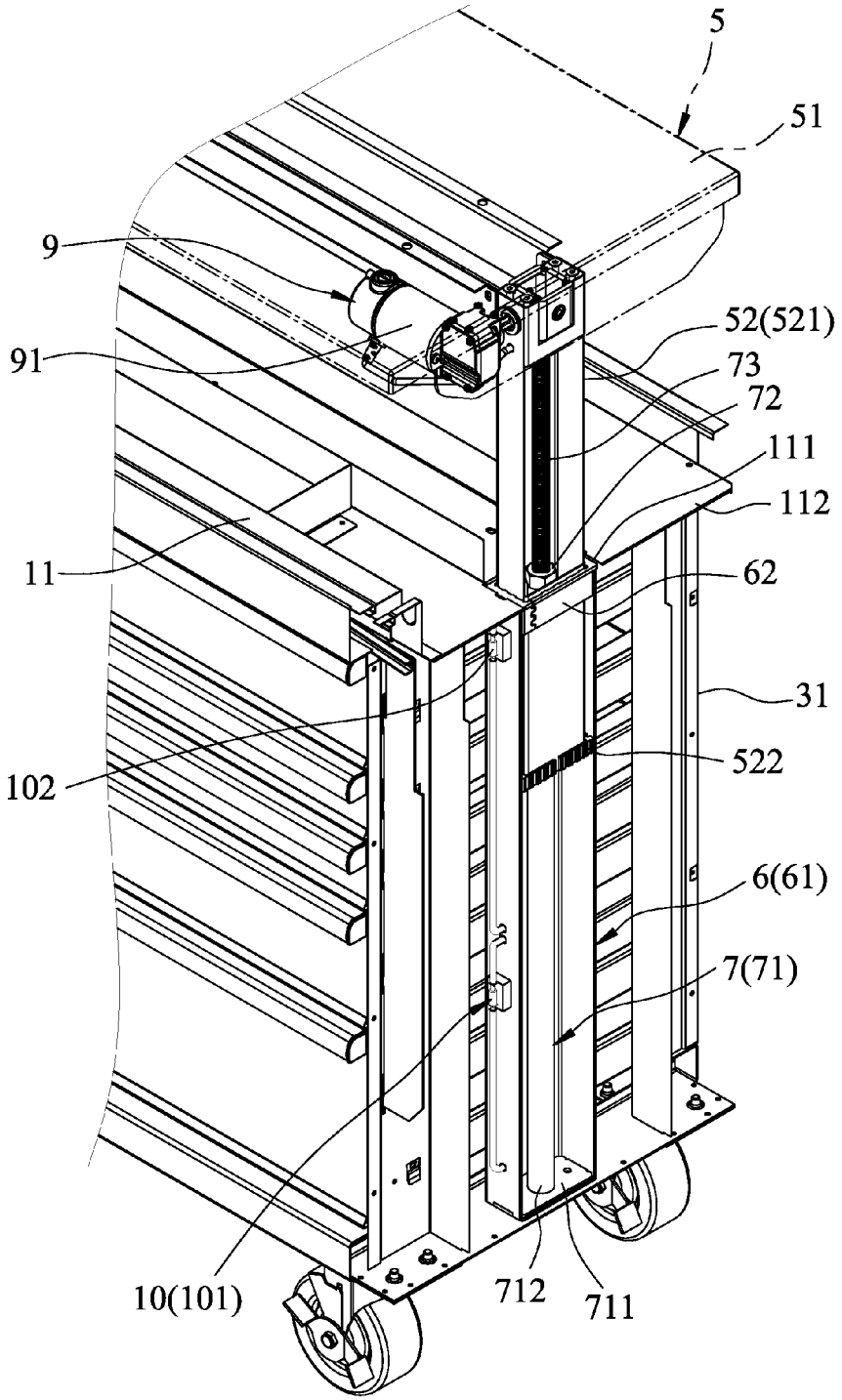
FIG. 3 is a fragmentary sectional view of the embodiment.

Referring to FIGS. 1 to 3, the embodiment of a tool cabinet according to the disclosure includes a cabinet housing 1, a plurality of drawers 2, two side plates 3, a working platform 5, two slide rails 6, two lifting units 7, a linkage unit 8, a drive unit 9, and a limit unit 10.

The cabinet housing 1 includes a top cover 11 that has a hole-defining surface 112 formed with two through holes 111. The drawers 2 are movably disposed in the cabinet housing 1. The side plates 3 are disposed on opposite sides of the cabinet housing 1, and cooperate with the cabinet housing 1 to respectively define two receiving spaces 31.

The working platform unit 5 has a platform member 51 disposed above the top cover 11 of the cabinet housing 1, and two extension members 52 extending respectively and downwardly from two opposite ends of the platform member 51 through the top cover 11. The working platform unit 5 is displaceable relative to the top cover 11 between a lifted position (see FIGS. 2 and 4), where the platform member 51 is distal from the cabinet housing 1, and a lowered position (see FIGS. 5 and 7), where the platform member 51 is proximate to the cabinet housing 1, cooperates with the top cover 11 to define an anti-jamming gap 511 therebetween, and is not allowed to move further toward the top cover. Each of the extension members 52 has a main portion 521 that extends downwardly from a respective one of the two opposite ends of the platform member 51, and an engaging portion 522 that surrounds and protrudes from a bottom end of the main portion 521.

The two slide rails 6 are respectively disposed at the opposite sides of the cabinet housing 1 in the receiving spaces 31, and are engaged respectively and slidably by the extension members 52 of the working platform unit 5. Each of the slide rails 6 has a slide portion 61 that has an inner surface surrounding the main portion 521 of a respective one of the extension members 52, and an abutment portion 62 that is disposed in a respective one of the through holes 111, that is connected to a top end of the slide portion 61, that surrounds and abuts against the main portion 521 of the respective one of the extension members 52, and that retains the engaging portion 522 of the respective one of extension members 52 within the slide portion 61. The abutment portions 62 of the slide rails 6 are flush with the hole-defining surface 112 of the top cover 11.

Figure 6:
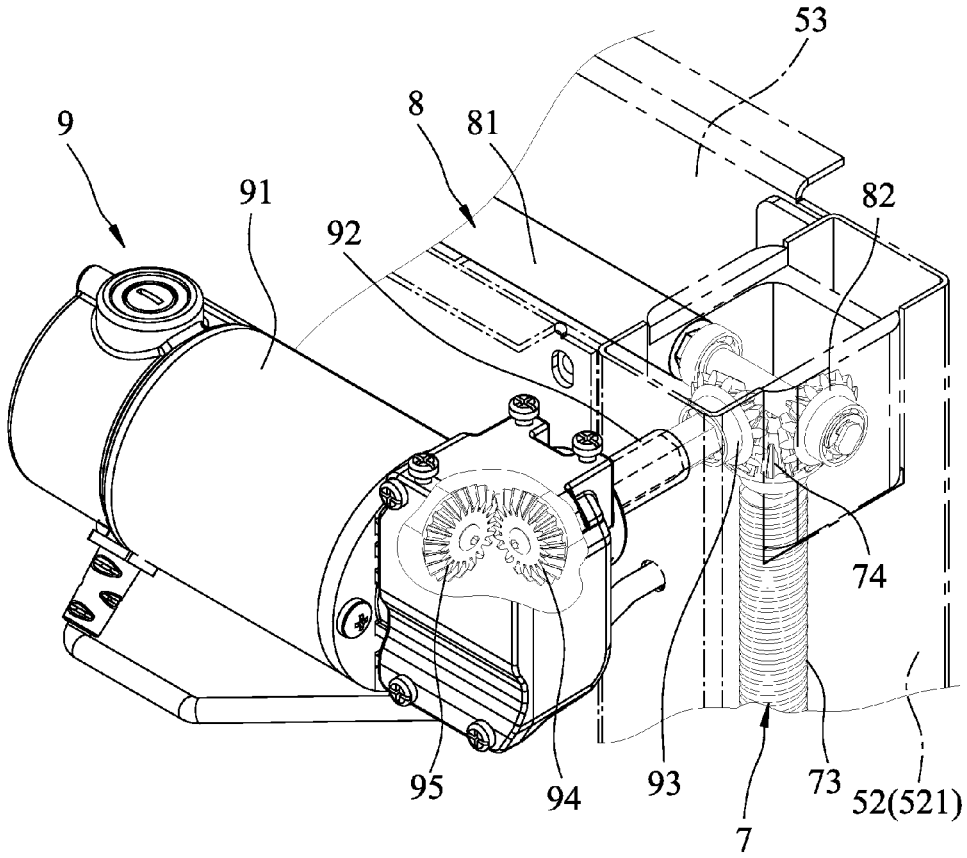
FIG. 6 is an enlarged fragmentary perspective view of the embodiment illustrating a drive unit.

Referring to FIGS. 1, 3, and 6, the two lifting units 7 are respectively and movably disposed at the opposite sides of the cabinet housing 1 in the receiving spaces 31, and are connected to the working platform unit 5. Each of the lifting units 7 has a guide tube 71 that is disposed in a respective one of the slide rails 6, a nut 72 that is disposed on a top end of the guide tube 71, a threaded rod 73 that is threadedly connected to the nut 72 and that has a top end adjacent to the platform member 51 and an opposite end inserted telescopically into the guide tube 71, and a transmission bevel gear 74 that is fixedly disposed on the top end of the threaded rod 73. The guide tube 71 of each of the lifting units 7 has a support portion 711 that is connected to the cabinet housing 1, and a tube portion 712 that extends upwardly from the support portion 711.

Further referring to FIGS. 1 and 6, the linkage unit 8 interconnects the lifting units 7 and synchronizes movement of the lifting units 7. The linkage unit 8 includes a linkage rod 81 that is disposed below the platform member 51, that extends along a horizontal axis, and that is rotatable about the horizontal axis, and two linkage bevel gears 82 that are respectively connected to two opposite ends of the linkage rod 81 and that respectively mesh with the transmission bevel gears 74 of the lifting units 7.

The drive unit 9 is drivingly connected to one of the lifting units 7, and is operable to drive synchronized movements of the lifting units 7 to move the working platform unit 5 along the slide rails 6 between the lifted position and the lowered position. The drive unit 9 includes a motor 91, a drive rod 92, a first drive bevel gear 93, a second drive bevel gear 94, and a third drive bevel gear 95.

The motor 91 of the drive unit 9 is mounted to the working platform unit 5, and is connected to the one of the lifting units 7 and to a respective one of the linkage bevel gears 82 of the linkage unit 8. The first drive bevel gear 93 is connected to the motor 91 and meshes with the transmission bevel gear 74 of the one of the lifting units 7 with gear axes of the first drive bevel gear 93 and the transmission bevel gear 74 being positioned at a right angle. The drive rod 92 has a first end connected to the first drive bevel gear 93 and a second end opposite to the first end. The second drive bevel gear 94 is connected to the second end of the drive rod 92. The third drive bevel gear 95 meshes with the second drive bevel gear 94 and is driven rotatably by the motor 91. As such, the drive unit 9 drives the one of the lifting units 7 for synchronous movement of the linkage unit 8, so that the working platform unit 5 is able to move upwardly and downwardly along the slide rails 6.

Referring to FIG. 3, the limit unit 10 is connected electrically to the motor 91 of the drive unit 9, detects a level of the working platform unit 5, and includes upper and lower switches 102, 101 that are connected electrically to the motor 91 and that are mounted on the slide portion 61 of one of the slide rails 6.

Referring to FIG. 6, when lifting or lowering the working platform unit 5, a user starts the motor 91 to synchronously drive rotation of the first drive bevel gear 93 via the drive rod 92 and the second and third drive bevel gears 94, 95, thereby driving synchronous movement of the transmission bevel gear 74 of the one of the lifting units 7, which in turn drives synchronous movement of the respective one of the linkage bevel gears 82 of the linkage unit 8.

Figure 4:
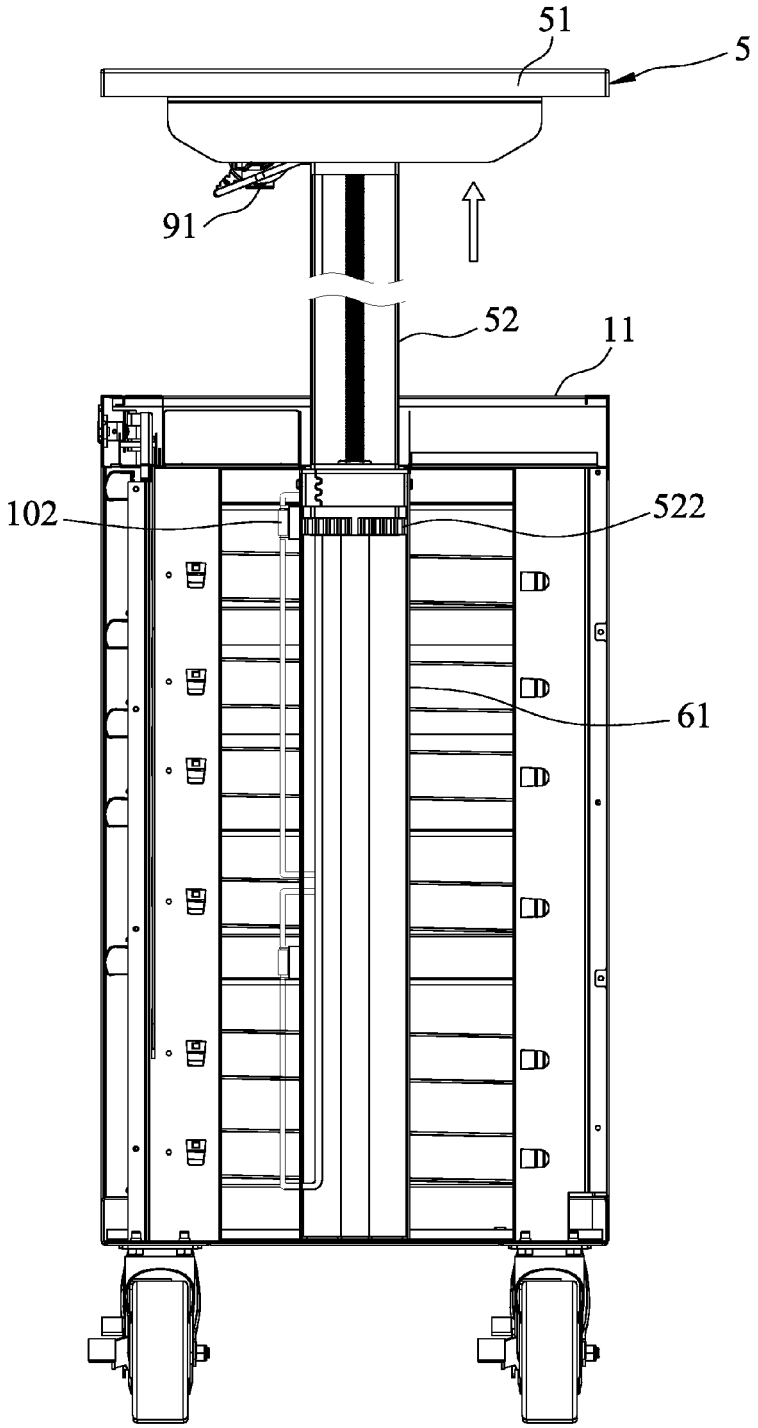
FIG. 4 is a fragmentary side view of the embodiment illustrating a working platform unit of the tool cabinet at the lifted position.

Referring to FIG. 4, when the working platform unit 5 is moved toward the lifted position, the extension members 52 of the working platform unit 5 move upwardly at the same speed, so that the platform member 51 moves away from the top cover 11 until the engaging portion 522 of a respective one of the extension members 52 comes in contact with the upper switch 102, which cuts off the supply of power of the motor 91 to position the working platform unit 5 relative to the top cover 11 at the lifted position. It should be noted that when the extension member 52 comes in contact with the upper switch 102, the abutment portion 62 of the one of the slide rails 6 does not yet abut against the engaging portion 522 of the respective one of the extension member 52, thereby preventing damage to the abutment portions 62 of the slide rails 6 and the engaging portions 522 of the extension members 52 due to collisions therebetween.

Figure 5:
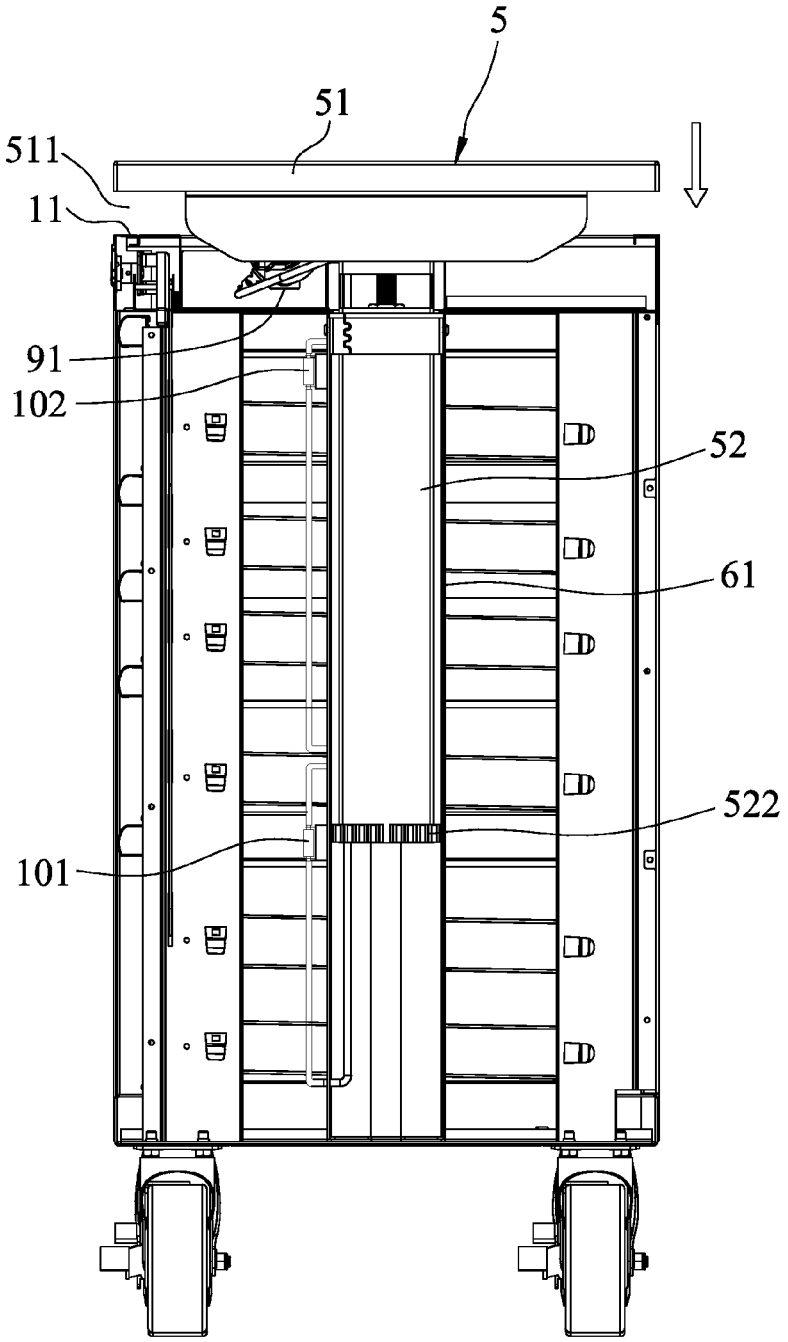
FIG. 5 is a side view of the embodiment illustrating the working platform unit at a lowered position, wherein an anti-jamming gap is defined between a platform member and a top cover of the tool cabinet.
Figure 7:
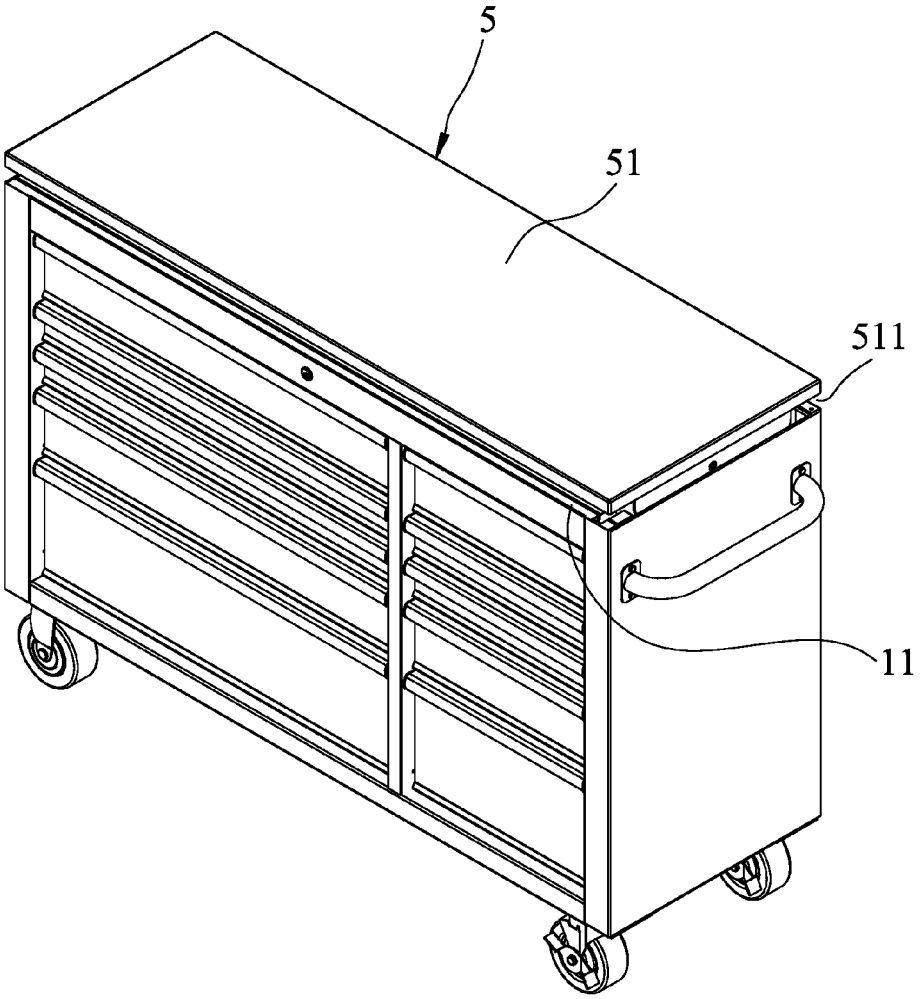
FIG. 7 is an assembled perspective view of the embodiment illustrating a working platform unit of the tool cabinet at the lowered position.

Referring to FIGS. 5 and 7, when the working platform unit 5 is moved toward the lowered position, the extension members 52 of the working platform unit 5 move downwardly at the same speed into the slide portions 61 of the slide rails 6, so that the platform member 51 moves toward from the top cover 11 until the engaging portion 522 of the respective one of the extension members 52 comes in contact with the lower switch 101, which cuts off the supply of power of the motor 91 to position the working platform unit 5 relative to the top cover 11 at the lowered position and the anti-jamming gap 511 is formed. It should be noted that when the extension member 52 comes in contact with the lower switch 101, the platform member 51 is restricted from moving any further toward the top cover 11, thereby preventing any injury to the user from jamming his/her hands between the platform member 51 and the top cover 11. It should be further noted that the function of the upper and lower switches 102, 101 may also be achieved by other equivalents such as sensors, mechanical limit switches, or non-mechanical switches (e.g., capacitors, resistive switches, etc.), and is not to be limited by the disclosure.

In sum, the working platform unit 5 of the tool cabinet according to the disclosure is able to move upwardly and downwardly along the slide rails 6 by virtue of the lifting units 7, the linkage unit 8, and the drive unit 9. By further virtue of the upper and lower switches 102, 101, the power supply of the motor 91 can be cut off to stop the movement of the working platform unit 5, thereby creating an anti-jamming gap 511 at the lowered position, making the tool cabinet safer to use than its predecessors.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A tool cabinet comprising:

a cabinet housing that includes a top cover;

a plurality of drawers that are movably disposed in said cabinet housing;

a working platform unit that has a platform member disposed above said top cover, and two extension members extending respectively and downwardly from two opposite ends of said platform member through said top cover, said working platform unit being displaceable relative to said top cover between a lifted position, where said platform member is distal from said cabinet housing, and a lowered position, where said platform member is proximate to said cabinet housing, cooperates with said top cover to define an anti-jamming gap therebetween, and is not allowed to move further toward said top cover;

two slide rails that are respectively disposed at opposite sides of said cabinet housing, said extension members engaging respectively and slidably said slide rails;

two lifting units that are respectively and movably disposed at the opposite sides of said cabinet housing, and that are connected to said working platform unit;

a linkage unit that interconnects said lifting units and that synchronizes movement of said lifting units; and a drive unit that is drivingly connected to one of said lifting units, and that is operable to drive synchronized movements of said lifting units to move said working platform unit along said slide rails between the lifted position and the lowered position.

2. The tool cabinet as claimed in claim 1, wherein said drive unit includes a motor that is connected to the one of said lifting units.

3. The tool cabinet as claimed in claim 2, further comprising a limit unit that is connected electrically to said motor, that detects a level of said working platform unit, and that is operable to cut off the supply of power of said motor to position said working platform unit relative to said top cover when said working platform unit is at the lowered position.

4. The tool cabinet as claimed in claim 3, wherein said limit unit includes a lower switch that is connected electrically to said motor, that is mounted on one of said slide rails, and that cuts off the supply of power of said motor upon contact with a respective one of said extension members of said working platform unit to position said working platform unit relative to said top cover when said working platform unit is at the lowered position.

5. The tool cabinet as claimed in claim 4, wherein said limit unit includes an upper switch that is connected electrically to said motor, that is mounted on one of said slide rails, and that cuts off the supply of power of said motor upon contact with a respective one of said extension members of said working platform unit to position said working platform unit relative to said top cover when said working platform unit is at the lifted position.

6. The tool cabinet as claimed in claim 5, wherein:

each of said extension members has a main portion that extends downwardly from a respective one of the two opposite ends of said platform member, and an engaging portion that surrounds and protrudes from a bottom end of said main portion;

each of said slide rails has a slide portion that has an inner surface surrounding said main portion of a respective one of said extension members, and an abutment portion that is connected to a top end of said slide portion, that surrounds and abuts against said main portion of the respective one of said extension members, and that retains said engaging portion of the respective one of extension members within said slide portion; and said lower switch and said upper switch are mounted on said slide portion of the same one of said slide rails.

7. The tool cabinet as claimed in claim 6, wherein:

said top cover has a hole-defining surface that is formed with two through holes; and said abutment portions of said slide rails are respectively disposed in said through holes and are flush with said hole-defining surface.

8. The tool cabinet as claimed in claim 2, wherein:

each of said lifting units has a guide tube that is disposed in a respective one of said slide rails, a nut that is disposed on a top end of said guide tube, a threaded rod that is threadedly connected to said nut and that has a top end adjacent to said platform member and an opposite end inserted telescopically into said guide tube, and a transmission bevel gear that is fixedly disposed on said top end of said threaded rod;

said linkage unit includes a linkage rod that is disposed below said platform member, that extends along a horizontal axis, and that is rotatable about the horizontal axis, and two linkage bevel gears that are respectively connected to two opposite ends of said linkage rod and that respectively mesh with said transmission bevel gears of said lifting units; and said motor of said drive unit is mounted to said working platform unit and is connected to one of said linkage bevel gears.

9. The tool cabinet as claimed in claim 8, wherein said drive unit further includes a first drive bevel gear that is connected to said motor and that meshes with said transmission bevel gear of the one of said lifting units.

10. The tool cabinet as claimed in claim 9, wherein said drive unit further includes:

a drive rod having a first end connected to said first drive bevel gear, and a second end opposite to said first end;

a second drive bevel gear connected to said second end of said drive rod; and a third drive bevel gear meshing with said second drive bevel gear and driven rotatably by said motor.

* * * * *